US012478821B2

(12) United States Patent
Renaud

(10) Patent No.: US 12,478,821 B2
(45) Date of Patent: Nov. 25, 2025

(54) WEIGHT EXERCISE SYSTEM AND APPARATUS

(71) Applicant: Robert M. Renaud, Dallas, TX (US)

(72) Inventor: Robert M. Renaud, Dallas, TX (US)

(73) Assignee: Robert Renaud Enterprises LLC, Dallas, TX (US)

( * ) Notice: Subject to any disclaimer, the term of this patent is extended or adjusted under 35 U.S.C. 154(b) by 132 days.

(21) Appl. No.: 18/230,370

(22) Filed: Aug. 4, 2023

(65) Prior Publication Data

US 2025/0041648 A1 Feb. 6, 2025

(51) Int. Cl.
*A63B 21/065* (2006.01)

(52) U.S. Cl.
CPC ..... *A63B 21/065* (2013.01)

(58) Field of Classification Search
CPC ..... A63B 21/072; A63B 23/0222; A63B 23/0482; A63B 21/0442; A63B 21/0552; A63B 21/0726; A63B 21/065; A63B 21/4009; A63B 2209/10; A63B 2209/08; A63B 2208/0247
See application file for complete search history.

(56) References Cited

U.S. PATENT DOCUMENTS

| | | | | |
|---|---|---|---|---|
| 10,709,930 | B2 | 7/2020 | Fleming et al. | |
| 11,135,464 | B2 | 10/2021 | Ballestero | |
| 11,369,831 | B2 | 6/2022 | Beck et al. | |
| 11,529,541 | B1 * | 12/2022 | Inniss | A63B 21/0726 |
| 11,577,123 | B1 | 2/2023 | Saffaie et al. | |
| D983,897 | S | 4/2023 | Beck et al. | |
| D1,023,188 | S * | 4/2024 | Tokar | D21/683 |
| 2004/0043875 | A1 | 3/2004 | Lederfeind | |
| 2014/0256519 | A1 * | 9/2014 | Nelson | A63B 21/065 482/105 |
| 2014/0274594 | A1 * | 9/2014 | Medina | A63B 21/065 482/105 |
| 2016/0113807 | A1 | 4/2016 | Hinton, Sr. | |
| 2022/0088433 | A1 * | 3/2022 | Panesso Ramirez | A63B 21/00069 |
| 2022/0331647 | A1 | 10/2022 | Gardiner, II | |
| 2023/0321475 | A1 | 10/2023 | Duplain | |

* cited by examiner

*Primary Examiner* — Andrew M Kobylarz
(74) *Attorney, Agent, or Firm* — Olav M. Underdal; IDP Patent Services

(57) ABSTRACT

A weight exercise system includes a weight exercise device with an elongated body with left and right mounting member, and left and right mounting harnesses, each including an inner mounting connector, an intermediate member, and an outer weight receiver; such that the weight exercise system is configured to be used for a weight exercise with the weight exercise device mounted on a body portion of a user, with corresponding weights attached to the weight exercise device.

25 Claims, 7 Drawing Sheets

Weight Exercise System

WEIGHT EXERCISE SYSTEM AND APPARATUS

CROSS-REFERENCE TO RELATED APPLICATIONS

N/A.

FIELD OF THE INVENTION

The present invention relates generally to the field of weight exercises methods and systems, and more particularly to body-mounted weight exercise methods and systems for training the gluteal and hamstring muscles.

BACKGROUND OF THE INVENTION

As a part of weight training there is a particular demand for devices and methods targeting training of the gluteal and hamstring muscles.

However, available systems and methods are either very large and expensive benches, that are not suitable for home use, or poorly designed personal devices that may not be practical or safe for consumer use.

As such, considering the foregoing, it may be appreciated that there continues to be a need for novel and improved body-mounted weight exercise devices and methods for training of the gluteal and hamstring muscles.

SUMMARY OF THE INVENTION

The foregoing needs are met, to a great extent, by the present invention, wherein in aspects of this invention, enhancements are provided to the existing model of weight exercise for training the gluteal and hamstring muscles.

In an aspect, a weight exercise system can include:

a) a weight exercise device, which can include:
   i. an elongated body;
   ii. at least one left mounting member, which is positioned on a left portion of the elongated body; and
   iii. at least one right mounting member, which is positioned on a right portion of the elongated body;

b) a left mounting harness, such that an inner end of the left mounting harness can be configured to attach to the at least one left mounting member, and such that an outer end of the of the left mounting harness can be configured to detachably hold a corresponding weight; and c) a right mounting harness, such that an inner end of the right mounting harness can be configured to attach to the at least one right mounting member, and such that an outer end of the of the right mounting harness can be configured to detachably hold a corresponding weight;

such that the weight exercise system can be used for a weight exercise with the weight exercise device mounted on a body portion of a user, with corresponding left and right weights attached to the weight exercise device.

In a related aspect, each corresponding mounting harness of the left mounting harness and the right mounting harness can each include:

a) an inner mounting connector, which is positioned in an inner end of the corresponding mounting harness, such that the inner mounting connector is configured to detachably connect with a corresponding mounting member of the at least one left mounting member and the at least one right mounting member;

b) an outer weight receiver, which is positioned in an outer end of the corresponding mounting harness, such that the outer weight receiver is configured to detachably connect with a corresponding weight; and c) an intermediate member, which is connected between the inner mounting connector and the outer weight receiver.

In a further related aspect, the at least one left mounting member and the at least one right mounting member can each be configured as an elongated opening comprising an upper entry aperture; wherein the inner mounting connector can further include:

a) an inner hook portion, comprising an elongated vertical member;

such that the elongated vertical member is configured to be removably insertable through the upper entry aperture into the elongated opening.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1A:
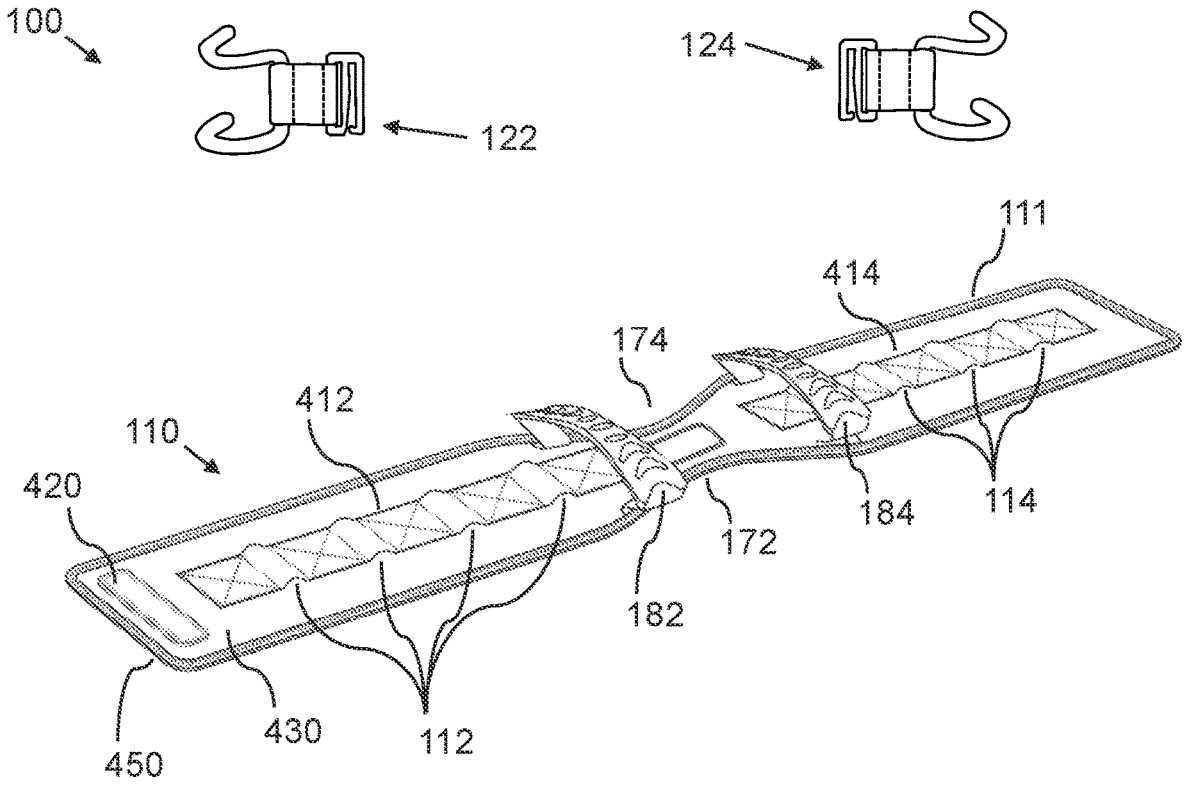
FIG. 1A is a perspective view of a weight exercise system in a disassembled configuration, according to an embodiment of the invention.
Figure 1B:
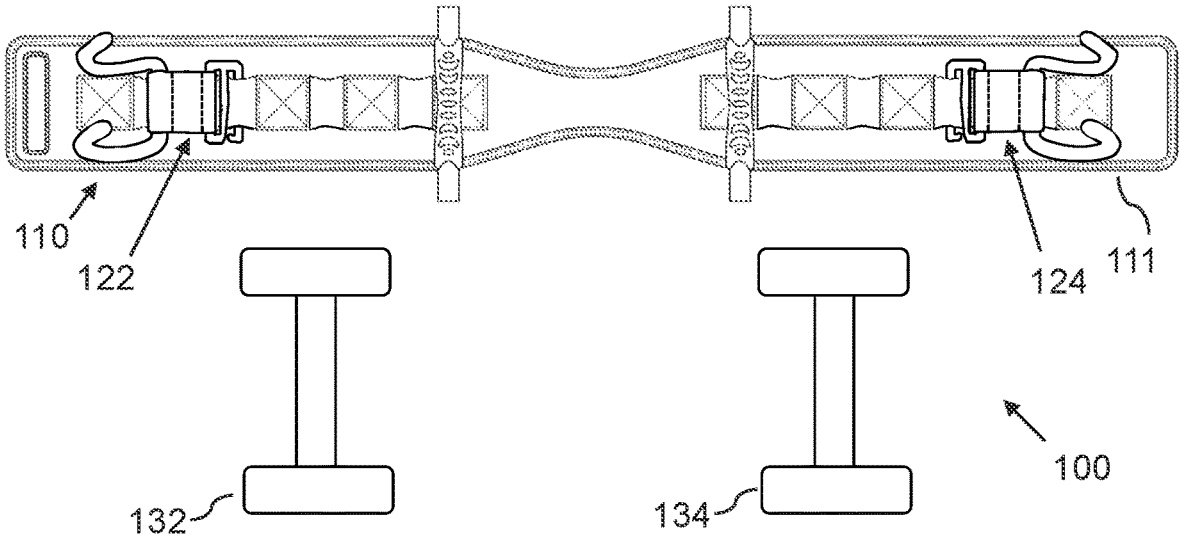
FIG. 1B is a perspective view of a weight exercise system in an assembled configuration with weights not attached, according to an embodiment of the invention.

In the following, we describe the structure of an embodiment of a system for weight exercise system 100 with reference to FIG. 1A, in such manner that like reference numerals refer to like components throughout; a convention that we shall employ for the remainder of this specification.

In various related embodiments, the weight exercise system 100 is designed for use to strengthen the gluteal and hamstring muscle groups. The weight exercise system 100 is designed for muscle fitness as well as correcting muscular imbalances from sitting at a desk for hours per day.

In further related embodiments, the weight exercise system 100 can be configured as a heavy-duty belt made from woven nylon with reinforced loops and a unique hooking system to accommodate different physical sizes. A pair of g-hooks are attached to a loop on opposite ends of the belt. The g-hook is attached to heavy duty woven nylon with a 2-prong hook attached to the other end. Each 2-prong hook is designed to hold a dumbbell or kettlebell. The belt is placed over the waist to perform a hip thrust or glute bridge exercise. Alternatively, the belt has a cutout to support the neck when placed over the shoulders to perform squats or lunges. the weight exercise system 100 can be made using reinforced materials to ensure quality, safety, and comfort. The weight exercise system 100 keeps the weight from twisting with improved control. The design is very compact and can be used in the home or while traveling.

Thus, in an embodiment, as shown in FIGS. 1A-1C and 2A-2C, a weight exercise system 100 can include:

a) a weight exercise device 110, which can include:
   i. an elongated body 111;
   ii. at least one left mounting member 112, which is positioned on a left portion of a top surface of the elongated body 111;
   iii. at least one right mounting member 114, which is positioned on a right portion of a top surface of the elongated body 111;
   iv. at least one left support protrusion 222 (which can be a vertically elongated molded protrusion), which is positioned on a left portion of a bottom surface the elongated body 111, directly opposite to the corresponding at least one left mounting member 112, to provide structural support when a right mounting harness 122 is connected to the at least one left mounting member 112; and
   v. at least one right support protrusion 224 (which can be a vertically elongated molded protrusion), which is positioned on a right portion of a bottom surface the elongated body 111, directly opposite to the corresponding at least one right mounting member 114, to provide structural support when a right mounting harness 124 is connected to the at least one right mounting member 114;

b) a left mounting harness 122, such that an inner end of the left mounting harness 122 can be configured to attach to the at least one left mounting member 112, and such that an outer end of the of the left mounting harness 122 can be configured to detachably hold a corresponding weight 132, 134; and c) a right mounting harness 124, such that an inner end of the right mounting harness 124 can be configured to attach to the at least one right mounting member 114, and such that an outer end of the of the right mounting harness 124 can be configured to detachably hold a corresponding weight 132, 134;

such that the weight exercise system 100 is used for a weight exercise with the weight exercise device 110 mounted on a body portion of a user, with corresponding left and right weights 132, 134 attached to the weight exercise device 110, as shown in FIGS. 5A-5B and 6A-6B.

Figure 3A:
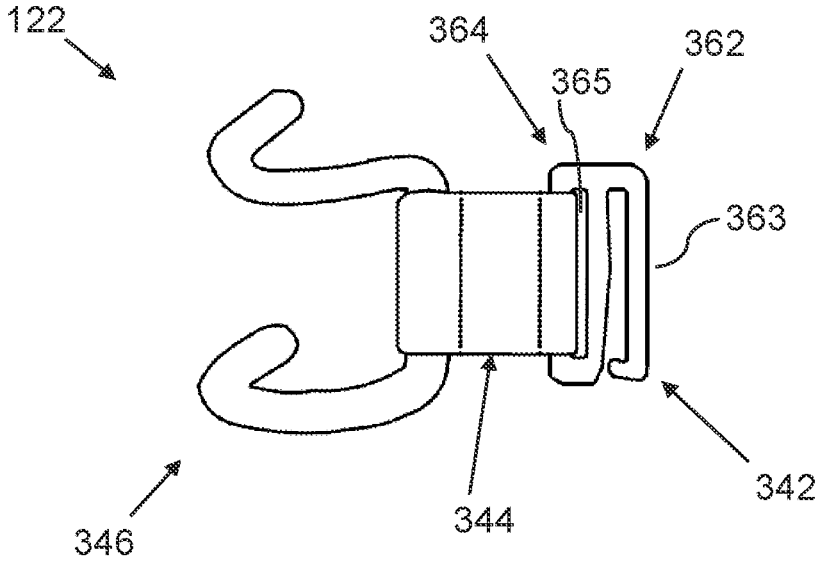
FIG. 3A is a front perspective view of a left mounting connector, according to an embodiment of the invention.
Figure 3B:
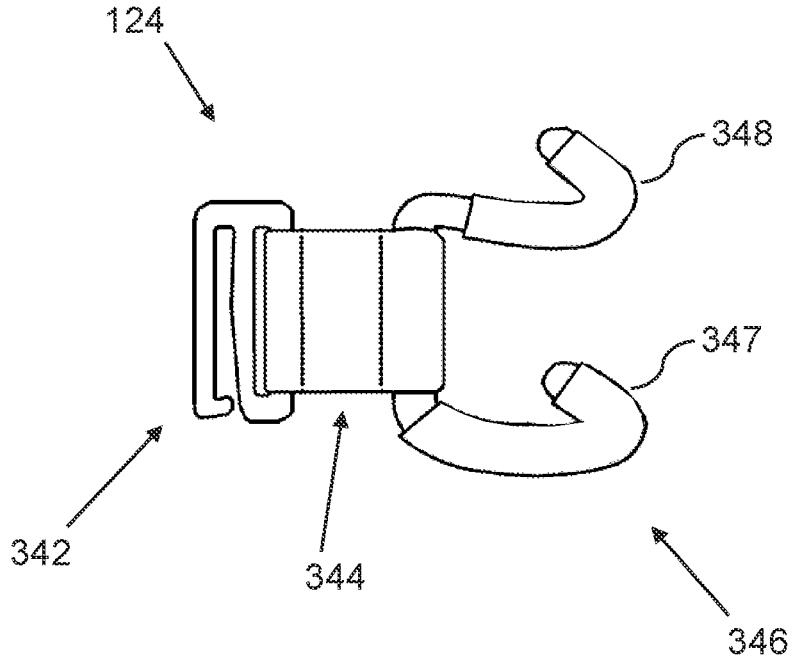
FIG. 3B is a front perspective view of a right mounting connector, according to an embodiment of the invention.

In a related embodiment, as shown in FIGS. 3A and 3B, each corresponding mounting harness 122, 124 of the left mounting harness 122 and the right mounting harness 124 can each include:

a) an inner mounting connector 342, which is positioned in an inner end of the corresponding mounting harness 122, 124, such that the inner mounting connector 342 is configured to detachably connect with a corresponding mounting member 112, 114 of the at least one left mounting member 112 and the at least one right mounting member 114;

b) an outer weight receiver 346, which is positioned in an outer end of the corresponding mounting harness 122, 124, such that the outer weight receiver 346 is configured to detachably connect with a corresponding weight 132, 134 of the corresponding left and right weights 132, 134; and c) an intermediate member 344, which is connected between the inner mounting connector 342 and the outer weight receiver 346.

Figure 1C:
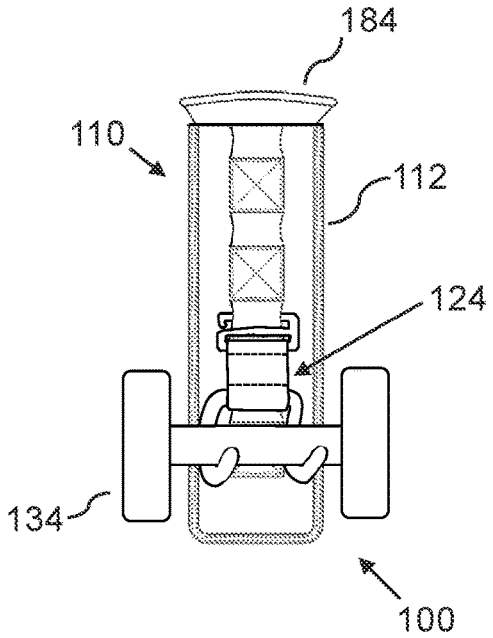
FIG. 1C is a side view of an end portion of a weight exercise system in a assembled configuration with a weight attached, according to an embodiment of the invention.
Figure 2A:
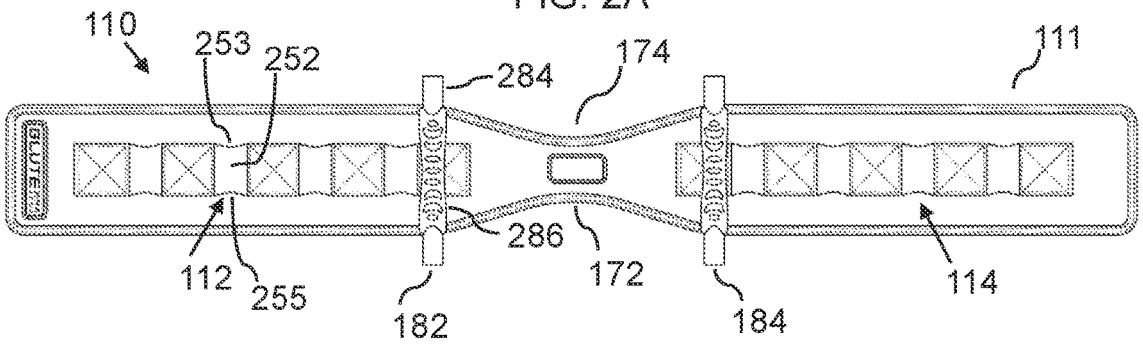
FIG. 2A is a top view of a weight exercise device, according to an embodiment of the invention.
Figure 2B:
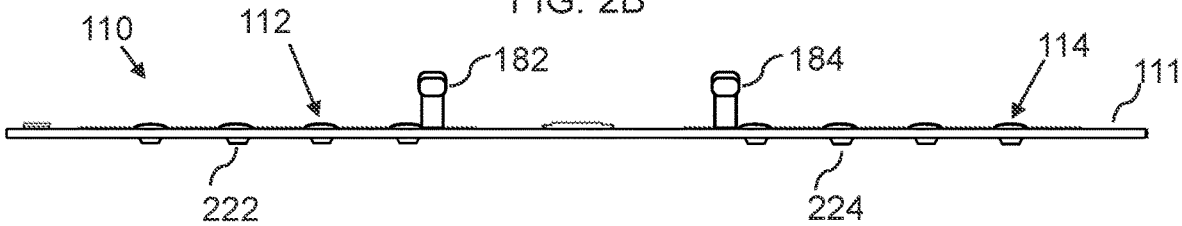
FIG. 2B is a front view of a weight exercise device, according to an embodiment of the invention.

In a further related embodiment, as shown in FIGS. 3A and 3B, wherein the at least one left mounting member 112 and the at least one right mounting member 114 are each configured as an elongated opening 252, comprising an upper entry aperture 253 and a lower entry aperture 255; and wherein the inner mounting connector 342 can further include:

b) an inner hook portion 362, comprising an elongated vertical member 363;

such that the elongated vertical member 363 is configured to be removably insertable through the upper entry aperture 253 (or the lower entry aperture 255) the into the elongated opening 252, as shown in FIGS. 1C and 2A.

In a yet further related embodiment, the inner mounting connector 342 can be configured as a g-hook, such that the inner mounting connector 342 can further include:

a) an outer loop portion 364, comprising an elongated aperture 365;

such that the outer loop portion 364 is connected to an outer side of the inner hook portion 362;

wherein the intermediate member 344 can be configured as a fabric strap;

wherein an inner end of the intermediate member 344 can be connected to the outer loop portion 364.

In a related embodiment, the outer weight receiver 346 can include at least one hook portion 347, 348, which is hook-shaped, such that the outer weight receiver 346 can further include:

a) a first hook portion 347; and b) a second hook portion 348;

such that the at least one hook portion 347, 348 can be configured to hold a handle of a selected weight 132, 134 of the corresponding left and right weights 132, 134, wherein the selected weight 132, 134 can for example be a dumbbell or kettlebell.

Figure 3C:
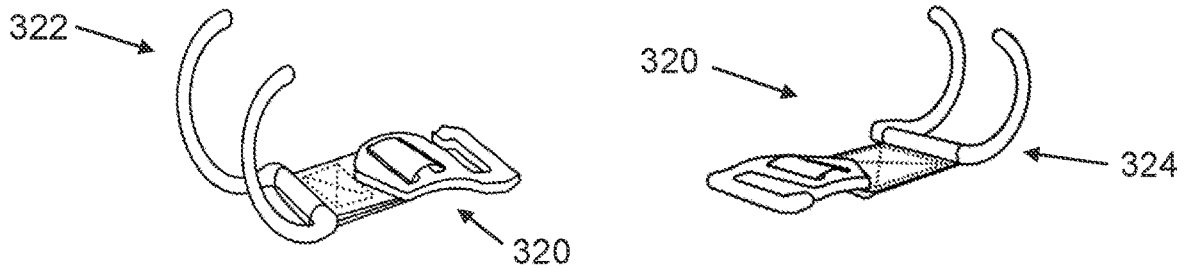
FIG. 3C is a front perspective view of a pair of identical left and right mounting connectors, according to an embodiment of the invention.

In another related alternative embodiment, FIG. 3C shows a pair of similar left and right mounting harnesses 320, 322, 324, which are configured to slide into respectively front and rear openings of a corresponding mounting member 112, 114.

In a related embodiment, the at least one left mounting member 112 can be a plurality of left mounting members 112 positioned along a left portion of the elongated body 111, which can be four left mounting members 112, which can be positioned with uniform spacing along a left portion of the elongated body 111; and the at least one right mounting member 114 can be a plurality of right mounting members 114 positioned along a right portion of the elongated body 111, which can be four right mounting members 114, which can be positioned with uniform spacing along a right portion of the elongated body 111.

Figure 5A:
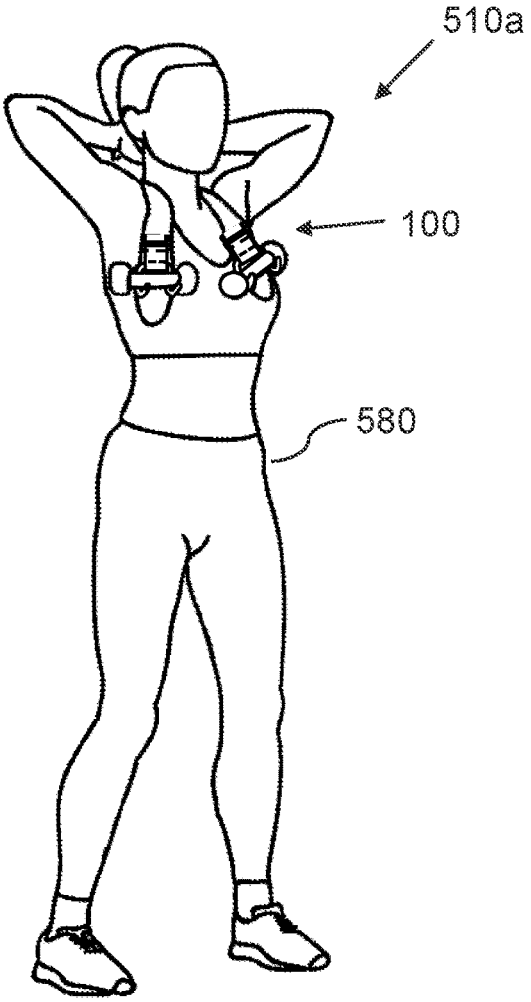
FIG. 5A is a perspective view of a weight exercise system mounted on a user during a first step of a squat exercise, according to an embodiment of the invention.
Figure 5B:
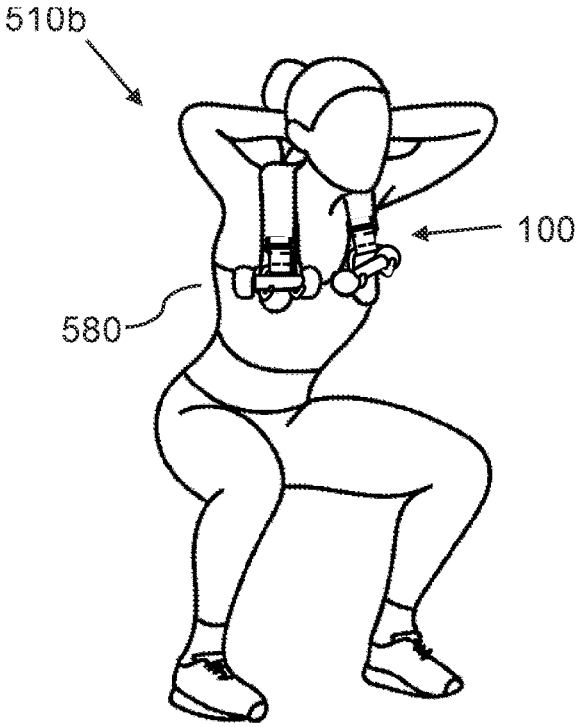
FIG. 5B is a perspective view of a weight exercise system mounted on a user during a second step of a squat exercise, according to an embodiment of the invention.

In another related embodiment, the elongated body 111 can further include:

a) a front neck cutout 172, which is positioned on a front side of a center portion of the elongated body 111; and b) a rear neck cutout 174, which is positioned on a rear side of the center portion of the elongated body 111;

wherein the front and rear neck cutouts 172, 174 are each configured with a rounded shape to adapt to a neck of a user;

such that the front neck cutout 172 (or rear neck cutout 174 depending on positioning) stabilizes a position of the weight exercise device 110 when the weight exercise device 110 is positioned over a neck of a user, as shown in FIGS. 5A and 5B.

In another related embodiment, as shown in FIGS. 2A-2B and 2D-2E, the weight exercise device 110 can further include at least one handle assembly 182, 184, which can be mounted on a top surface of the elongated body 111, between the at least one left mounting member 112 and the at least one right mounting member 114, wherein the at least one handle assembly 182, 184 can include:

a) a left handle assembly 182, which is positioned on a left portion of a top surface of the elongated body 111, such the left handle assembly 182 is positioned to a right of the at least one left mounting member 112; and b) a right handle assembly 184, which is positioned on a right portion of a top surface of the elongated body 111, such the right handle assembly 184 is positioned to a left of the at least one right mounting member 114;

such that at least one handle assembly 182, 184 facilitates carrying of the weight exercise device 110 with corresponding left and right weights 132, 134 attached to the weight exercise device 110.

In another related embodiment, each of the left and right handle assemblies 182, 184, can further include:

a) a handle strap 284; and b) a handle member 286, which can be molded from a plastic or rubber material, such that the handle member 286 can be mounted on a center portion of the handle strap 284;

such that the handle member 286 can be mounted on a center portion of the handle strap 284.

Figure 2C:
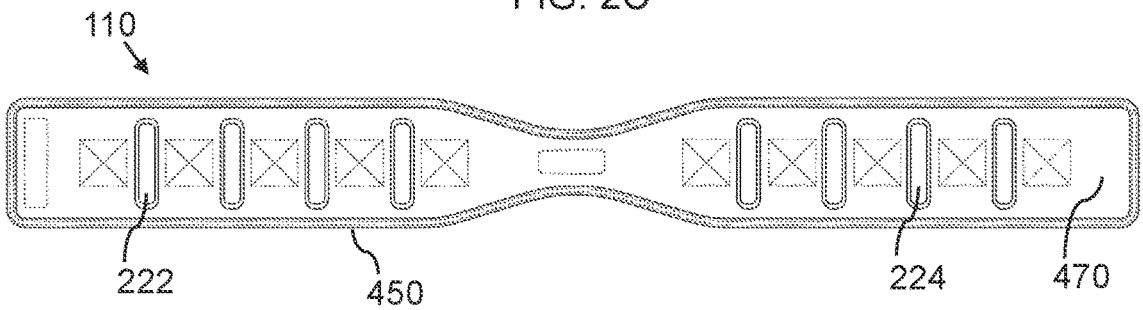
FIG. 2C is a bottom view of a weight exercise device, according to an embodiment of the invention.
Figure 2D:
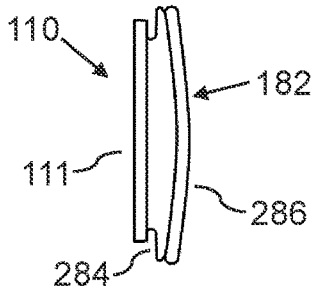
FIG. 2D is a side view of a weight exercise device with a carry handle in a folded-in configuration, according to an embodiment of the invention.
Figure 2E:
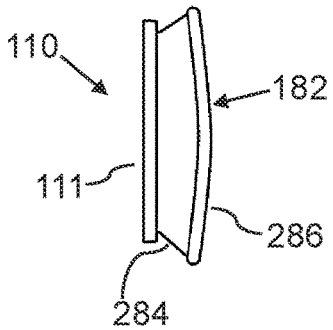
FIG. 2E is a side view of a weight exercise device with a carry handle in a folded-out configuration, according to an embodiment of the invention.
Figure 4:
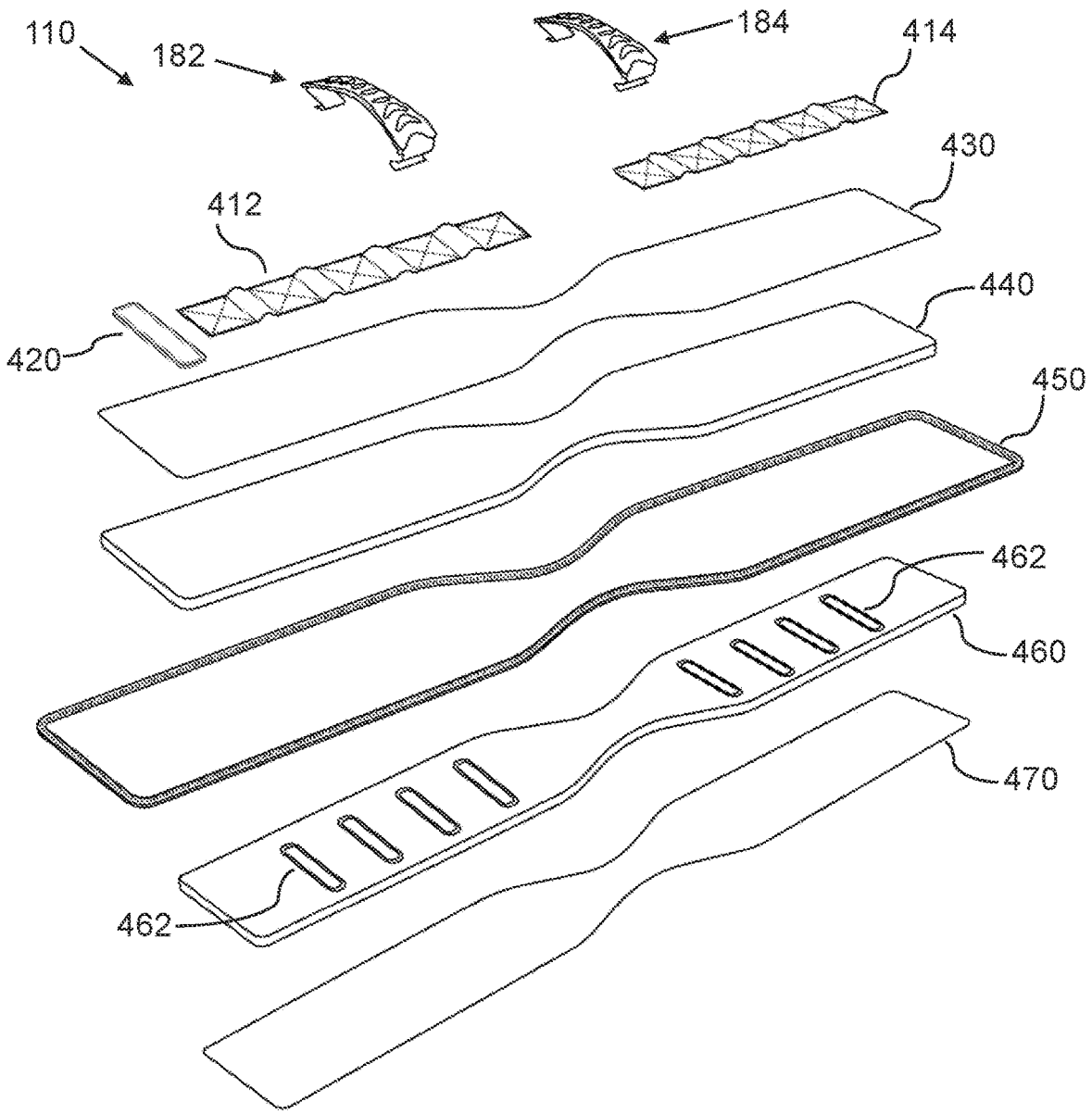
FIG. 4 is a perspective exploded view of parts of a weight exercise device, according to an embodiment of the invention.

In a related embodiment, as shown in FIGS. 1, 2C, and 4, the weight exercise device 110 can be configured as a sandwich construction built up from layers, such that the weight exercise device 110 can further include:

a) a left webbing strap 412 (that can be made from 38 mm nylon twill webbing), which is configured to form each of the left mounting members 112;

b) a right webbing strap 414 (that can be made from 38 mm nylon twill webbing), which is configured to form each of the left mounting members 112; and c) a logo member 420, which can include a logo marking;

d) a top fabric layer 430, which can be made from ballistic nylon;

e) a top foam layer 440, which is mounted below the top fabric layer 430, wherein the top foam layer 440 can be made from 5 mm ethylene-vinyl acetate copolymer foam;

f) a bottom foam layer 460, which is mounted below the top foam layer 440, wherein the bottom foam layer 460 can be made from 5 mm ethylene-vinyl acetate copolymer foam, wherein the bottom foam layer 460, can further include:

i. a plurality of molded protrusions 462, which are configured to form the left and right support protrusions 222, 224.

Note that the bottom foam layer 460 is shown upside down in FIG. 4 to show the molded protrusions 462;

g) a bottom fabric layer 470, which is mounted below the bottom foam layer 460, wherein the bottom fabric layer 470 can be made from a flexible neoprene material, which laminate to the bottom foam layer 460, such that the plurality of molded protrusions 462, indent an inner surface of the bottom fabric layer 470 to form the left and right support protrusions 222, 224 on an opposite outer surface of the bottom fabric layer 470; and h) a peripheral grosgrain edge binding 450, which can be double stitched, wherein the peripheral grosgrain edge binding 450 encircles a periphery of the sandwich construction of the top fabric layer 430, the top foam layer 440, the bottom foam layer 460, and the bottom fabric layer 470.

Figure 6A:
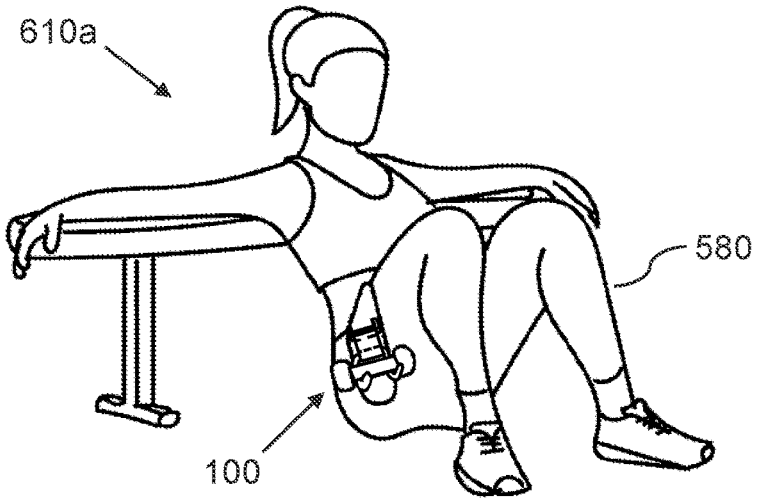
FIG. 6A is a perspective view of a weight exercise system mounted on a user during a first step of a hip thrust exercise, according to an embodiment of the invention.
Figure 6B:
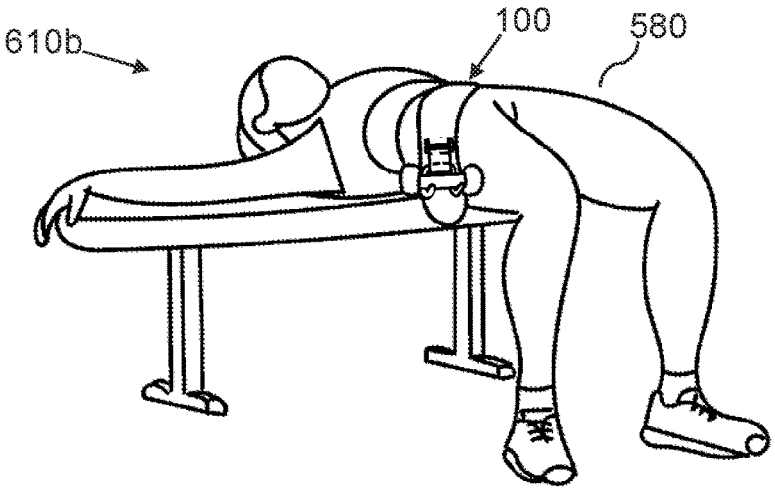
FIG. 6B is a perspective view of a weight exercise system mounted on a user during a second step of a hip thrust exercise, according to an embodiment of the invention.

In related embodiments, methods of use of the weight exercise system 100 can include:

a) the weight exercise system 100 mounted on a neck or over shoulders of a user 580 during a first step 510*a* of a squat exercise, as shown in FIG. 5A;

b) the weight exercise system 100 mounted on a neck or over shoulders of a user 580 during a second step 510*b* of a squat exercise, according to an embodiment of the invention, as shown in FIG. 5B;

c) the weight exercise system 100 mounted on hips or pelvis of a user 580 during a first step 610*a* of a hip thrust exercise, as shown in FIG. 6A; and d) the weight exercise system 100 mounted on hips or pelvis of a user during a second step 610*b* of a hip thrust exercise, as shown in FIG. 6B.

Here has thus been described a multitude of embodiments of the weight exercise system 100, the weight exercise device 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A weight exercise system, comprising:

a) a weight exercise device, which comprises:

an elongated body;

at least one left mounting member positioned on a left portion of the elongated body; and at least one right mounting member positioned on a right portion of the elongated body;

b) a left mounting harness, wherein an inner end of the left mounting harness is configured to attach to the at least one left mounting member, and such that an outer end of the left mounting harness is configured to detachably hold a corresponding left weight; and c) a right mounting harness, wherein an inner end of the right mounting harness is configured to attach to the at least one right mounting member, and such that an outer end of the right mounting harness is configured to detachably hold a corresponding right weight;

wherein each corresponding mounting harness of the left mounting harness and the right mounting harness further comprises:

an inner mounting connector positioned in an inner end of the corresponding mounting harness, such that the inner mounting connector is configured to detachably connect with a corresponding mounting member of the at least one left mounting member and the at least one right mounting member; and an outer weight receiver positioned in an outer end of the corresponding mounting harness, such that the outer weight receiver is configured to detachably connect with the corresponding weight of the corresponding left and right weights;

such that the weight exercise system is configured to be used for a weight exercise with the weight exercise device mounted on a body portion of a user, with the corresponding left and right weights attached to the weight exercise device.

2. The weight exercise system of claim 1, wherein each corresponding mounting harness of the left mounting harness and the right mounting harness further comprises:

an intermediate member connected between the inner mounting connector and the outer weight receiver.

3. The weight exercise system of claim 2, wherein the at least one left mounting member and the at least one right mounting member are each configured as an elongated opening comprising an upper entry aperture; and wherein the inner mounting connector further comprises:

an inner hook portion, comprising an elongated vertical member;

such that the elongated vertical member is configured to be removably insertable through the upper entry aperture into the elongated opening.

4. The weight exercise system of claim 3, wherein the inner mounting connector is configured as a g-hook, such that the inner mounting connector further comprises:

an outer loop portion, comprising an elongated aperture;

such that the outer loop portion is connected to an outer side of the inner hook portion;

wherein an inner end of the intermediate member is connected to the outer loop portion.

5. The weight exercise system of claim 4, wherein the intermediate member is configured as a fabric strap.

6. The weight exercise system of claim 1, wherein the outer weight receiver comprises:

at least one hook portion having a hook shape; and such that the at least one hook portion is configured to hold a handle of a selected weight of the corresponding left and right weights.

7. The weight exercise system of claim 6, wherein the at least one hook portion comprises:

a) a first hook portion; and b) a second hook portion.

8. The weight exercise system of claim 1, wherein the elongated body further comprises:

a front neck cutout positioned on a front side of a center portion of the elongated body;

such that the front neck cutout is configured to stabilize a position of the weight exercise device when the weight exercise device is positioned over a neck of the user.

9. The weight exercise system of claim 8, wherein the elongated body further comprises:

a rear neck cutout positioned on a rear side of the center portion of the elongated body;

such that the rear neck cutout is configured to stabilize a position of the weight exercise device when the weight exercise device is positioned over the neck of the user.

10. The weight exercise system of claim 1, wherein the weight exercise device further comprises:

at least one handle assembly mounted on a top surface of the elongated body, between the at least one left mounting member and the at least one right mounting member;

such that at least one handle assembly is configured to facilitate carrying of the weight exercise device with the corresponding left and right weights attached to the weight exercise device.

11. The weight exercise system of claim 10, wherein the at least one handle assembly further comprises:

a left handle assembly positioned on a left portion of the top surface of the elongated body, such the left handle assembly is positioned to a right of the at least one left mounting member; and a right handle assembly positioned on a right portion of the top surface of the elongated body, such the right handle assembly is positioned to a left of the at least one right mounting member.

12. A weight exercise system, comprising:

a) a weight exercise device, which comprises:

an elongated body; and at least one mounting member positioned on the elongated body; and b) at least one mounting harness, wherein an inner end of the at least one mounting harness is configured to attach to the at least one mounting member, and wherein an outer end of the at least one mounting harness is configured to detachably hold a corresponding weight;

wherein the at least one mounting harness further comprises:

an inner mounting connector positioned in an inner end of the at least one mounting harness, such that the inner mounting connector is configured to detachably connect with the at least one mounting member; and an outer weight receiver positioned in an outer end of the at least one mounting harness, such that the outer weight receiver is configured to detachably connect with the corresponding weight;

such that the weight exercise system is configured to be used for a weight exercise with the weight exercise device mounted on a body portion of a user with the corresponding weight attached to the weight exercise device.

13. The weight exercise system of claim 12, wherein the at least one mounting member comprises:

a) at least one left mounting member positioned on a left portion of the elongated body; and b) at least one right mounting member positioned on a right portion of the elongated body.

14. The weight exercise system of claim 13, wherein the weight exercise device further comprises:

at least one handle assembly mounted on a top surface of the elongated body, between the at least one left mounting member and the at least one right mounting member;

such that at least one handle assembly is configured to facilitate carrying of the weight exercise device with the corresponding weight attached to the weight exercise device.

15. The weight exercise system of claim 14, wherein the at least one handle assembly further comprises:

a left handle assembly positioned on a left portion of the top surface of the elongated body, such the left handle assembly is positioned to a right of the at least one left mounting member; and a right handle assembly positioned on a right portion of the top surface of the elongated body, such the right handle assembly is positioned to a left of the at least one right mounting member.

16. The weight exercise system of claim 12, wherein the at least one mounting harness further comprises:

an intermediate member connected between the inner mounting connector and the outer weight receiver.

17. The weight exercise system of claim 16, wherein the intermediate member is configured as a fabric strap.

18. The weight exercise system of claim 12, wherein the at least one mounting member is configured as an elongated opening comprising an upper entry aperture; and wherein the inner mounting connector further comprises:

an inner hook portion, comprising an elongated vertical member;

such that the elongated vertical member is configured to be removably insertable through the upper entry aperture into the elongated opening.

19. The weight exercise system of claim 18, wherein the inner mounting connector is configured as a g-hook, such that the inner mounting connector further comprises:

an outer loop portion, comprising an elongated aperture;

such that an inner end of the outer loop portion is connected to an outer side of the inner hook portion.

20. The weight exercise system of claim 12, wherein the outer weight receiver comprises:

at least one hook portion having a hook shape; and such that the at least one hook portion is configured to hold a handle of a selected weight of the corresponding weight.

21. The weight exercise system of claim 20, wherein the at least one hook portion comprises:

a) a first hook portion; and b) a second hook portion.

22. The weight exercise system of claim 12, wherein the at least one mounting harness comprises:

a) a left mounting harness, wherein an inner end of the left mounting harness is configured to attach to at least one left mounting member, and such that an outer end of the left mounting harness is configured to detachably hold the corresponding weight; and b) a right mounting harness, wherein an inner end of the right mounting harness is configured to attach to at least one right mounting member, and such that an outer end of the right mounting harness is configured to detachably hold the corresponding weight.

23. The weight exercise system of claim 12, wherein the elongated body further comprises:

a front neck cutout positioned on a front side of a center portion of the elongated body;

such that the front neck cutout is configured to stabilize a position of the weight exercise device when the weight exercise device is positioned over a neck of the user.

24. A weight exercise system, comprising:

a) a weight exercise device, which comprises:

an elongated body; and at least one mounting member positioned on the elongated body;

wherein the elongated body further comprises:

a front neck cutout positioned on a front side of a center portion of the elongated body;

such that the front neck cutout is configured to stabilize a position of the weight exercise device when the weight exercise device is positioned over a neck of a user; and b) at least one mounting harness, wherein an inner end of the at least one mounting harness is configured to attach to the at least one mounting member, and wherein an outer end of the at least one mounting harness is configured to detachably hold a corresponding weight;

such that the weight exercise system is configured to be used for a weight exercise with the weight exercise device mounted on a body portion of the user with the corresponding weight attached to the weight exercise device.

25. A weight exercise system, comprising:

a) a weight exercise device, which comprises:

an elongated body; and at least one mounting member positioned on the elongated body, wherein the at least one mounting member comprises:

at least one left mounting member positioned on a left portion of the elongated body; and at least one right mounting member positioned on a right portion of the elongated body; and at least one handle assembly mounted on a top surface of the elongated body, between the at least one left mounting member and the at least one right mounting member;

such that the at least one handle assembly is configured to facilitate carrying of the weight exercise device with the corresponding weight attached to the weight exercise device; and b) at least one mounting harness, wherein an inner end of the at least one mounting harness is configured to attach to the at least one mounting member, and wherein an outer end of the at least one mounting harness is configured to detachably hold a corresponding weight;

such that the weight exercise system is configured to be used for a weight exercise with the weight exercise device mounted on a body portion of a user with the corresponding weight attached to the weight exercise device.

* * * * *